US011576534B2

(12) United States Patent
Bing et al.

(10) Patent No.: US 11,576,534 B2
(45) Date of Patent: Feb. 14, 2023

(54) SELECTIVELY SECURED LIQUID DISPENSER, MOUNT AND ASSOCIATED METHOD

(71) Applicant: Cintas Corporate Services, Inc., Cincinnati, OH (US)

(72) Inventors: Richard R. Bing, West Chester, OH (US); Megan Kathryn Helms, Hamilton, OH (US); David Steven Mesko, Wyoming, OH (US); Michael E. Berger, Brooklyn, NY (US); Adem Önalan, Jersey City, NJ (US); Marco C. Perry, Brooklyn, NY (US)

(73) Assignee: Cintas Corporate Services, Inc., Cincinnati, OH (US)

( * ) Notice: Subject to any disclaimer, the term of this patent is extended or adjusted under 35 U.S.C. 154(b) by 0 days.

(21) Appl. No.: 17/465,164

(22) Filed: Sep. 2, 2021

(65) Prior Publication Data

US 2022/0192435 A1 Jun. 23, 2022

Related U.S. Application Data

(60) Provisional application No. 63/128,253, filed on Dec. 21, 2020.

(51) Int. Cl.
*A47K 5/12* (2006.01)

(52) U.S. Cl.
CPC ..... *A47K 5/1205* (2013.01); *A47K 2201/02* (2013.01)

(58) Field of Classification Search
CPC .. A47K 5/1205; A47K 5/1207; A47K 5/1215; A47K 5/12; A47L 13/512; F16B 2/10; F16B 5/0657; F16B 21/09; F16M 11/105; F16M 13/02; F16M 13/022; A45F 5/02
USPC ..... 222/180, 181.3, 181.1
See application file for complete search history.

(56) References Cited

U.S. PATENT DOCUMENTS

| | | | | |
|---|---|---|---|---|
| 5,148,948 | A | 9/1992 | Granville et al. | |
| D335,791 | S | 5/1993 | Cumley | |
| 5,240,147 | A | 8/1993 | Frazier et al. | |
| 5,480,068 | A | 1/1996 | Frazier et al. | |
| 5,758,853 | A * | 6/1998 | Perrin | A47K 5/12 248/311.2 |
| 6,910,604 | B2 | 6/2005 | Gugliotti et al. | |
| 7,156,353 | B2 * | 1/2007 | Kringel | A47F 7/283 248/103 |
| 7,315,245 | B2 | 1/2008 | Lynn et al. | |

(Continued)

*Primary Examiner* — Vishal Pancholi
*Assistant Examiner* — Robert K Nichols, II
(74) *Attorney, Agent, or Firm* — Wood Herron & Evans LLP

(57) ABSTRACT

A liquid dispenser includes of a bottle for housing the liquid, a pumping mechanism for discharging liquid from the bottle, and a boss that is connected to and extends from the bottom of the bottle. The boss on the bottle mates with a socket in a base to selectively secure the bottle to the base and a countertop or wall mounted support. The boss and socket are shaped so as to allow for a single orientation of the bottle. The combination of the boss on the bottle and the socket in the base provides a counter-top mounting system to securely anchor the liquid dispensing device. The apparatus also allows the soap reservoir to be easily refilled and utilizes readily available pump components.

21 Claims, 20 Drawing Sheets

(56) References Cited

U.S. PATENT DOCUMENTS

| | | | | |
|---|---|---|---|---|
| 8,365,963 | B2 | 2/2013 | McCullough et al. | |
| 9,427,117 | B2 | 8/2016 | Barclay | |
| 2005/0184097 | A1* | 8/2005 | LeBlond | A47K 5/12 222/321.7 |
| 2006/0144861 | A1* | 7/2006 | Harrison | A47K 5/1202 222/173 |
| 2011/0259920 | A1* | 10/2011 | Rennie | A47K 5/1205 222/165 |
| 2022/0065393 | A1* | 3/2022 | Schmitt | F16M 13/02 |

* cited by examiner

SELECTIVELY SECURED LIQUID DISPENSER, MOUNT AND ASSOCIATED METHOD

This claims the benefit of U.S. Provisional Patent Application Ser. No. 63/128,253, filed Dec. 21, 2020 and hereby incorporated by reference in its entirety.

BACKGROUND OF THE INVENTION

This invention relates generally to liquid dispensers and more particularly, to such dispensers which can be selectively secured to a countertop, wall or other surface.

A number of countertop mounted liquid dispensers are known in the prior art. These dispensers have typically included refillable soap reservoirs into which dip tubes are inserted. Dip tubes have typically included one or two check valves with a piston-type pump. These pump and valve arrangements for countertop mounted soap dispensers have traditionally been intended as permanent installations and over a period of time the valves and/or pumps often fail or become clogged such that no soap can be dispensed.

Counter-top liquid soap dispensers often have a problem with placement. The liquid soap dispenser must be placed on an already crowded counter adjacent the sink. In the past, these dispensers had no anchoring and were often tipped over or knocked into the sink. Counter-top dispensers are especially likely to be tipped over when they are low on liquid and are top heavy.

Many public bathrooms in business establishments such as offices and restaurants have soap dispensers that include soap-filled bottles mounted under the counter next to the sinks. The dispensers have spouts that are disposed above the counter and are attached to the under-mounted bottles so that soap can be pumped from the respective bottles. Typically, large holes are bored into the counter so that the spout and bottle can be securely attached to one another to form the dispenser assembly. There are several drawbacks to this type of dispenser assembly. First, it is difficult to determine when the under-mounted soap bottle is empty or running low on soap because the bottle is not visible above the counter. Typically, a person has to go underneath the counter and unscrew the bottle to determine the amount of soap in it, which is labor-intensive and can be unsanitary. Also, the soap bottles are typically not disposable and must be refilled with soap. The process of pouring soap into the bottles can also be labor-intensive and messy.

Many operators of public bathrooms have explored replacing the prior art soap dispensers as described above with new soap dispensers that do not have the noted drawbacks. For example, some operators have used stand-alone soap dispensers that rest on top of but are not affixed to the countertop. Those dispensers, however, are often stolen by consumers who use them in their homes. Further, when the prior art dispensers are replaced with new means for delivering soap, the hole in the counter from the prior art dispenser remains and can be very unattractive.

Commonly, the dispensers include a label for identification or other markings for promotional, informational or marketing purposes. Free standing dispensers are prone to misplacement and misorientation such that these labels and markings are not readily visible to the user requiring the user to grasp the dispenser for proper placement and orientation thereby potentially spreading germs and other contaminants onto the dispenser for possible transfer to subsequent users.

Accordingly, what is lacking in the art is a dispenser having a mounting system that makes it possible to selectively secure and anchor the liquid dispensing device in a consistent and proper orientation and still allow portability, so the dispenser can be transported and used in other areas, as needed. The design should also allow the reservoir to be easily refilled and utilize readily available pump components.

SUMMARY OF THE INVENTION

These and other shortcomings in the prior art have been addressed by this invention which in various embodiments includes a selectively secured dispenser, mount and associated method. A liquid dispenser according to this invention includes a bottle for housing the liquid, a discharge mechanism for discharging liquid from the bottle, and a boss that is connected to and extends from the bottom of the bottle. In one embodiment, the boss is integrally molded with the bottle. The boss on the bottle mates with a socket in a base to selectively secure the bottle to the base and the base may be secured to a countertop or wall mounted support. The boss and socket are shaped so as to allow for a single orientation of the bottle when secured for proper orientation of the label on the bottle.

The combination of the boss on the bottle and the socket in the base provides a liquid dispensing apparatus having a countertop or wall mounting system that makes it possible to securely anchor the liquid dispensing device to a surface and still allow easy removal for permissible portability, so the dispenser can be transported and used in other areas, but not stolen from a public restroom or facility. The invention also allows the soap reservoir in the bottle to be easily refilled and utilizes readily available pump components in various embodiments of this invention. Embodiments of this invention may be used to dispense liquid soap, hand sanitizer, lotion, shampoo, conditioner, body soap and other flowable liquids.

BRIEF DESCRIPTION OF THE DRAWINGS

The above-mentioned and other features and advantages of this invention, and the manner of attaining them, will become more apparent and the invention itself will be better understood by reference to the following description of embodiments of the invention taken in conjunction with the accompanying drawings, wherein.

DETAILED DESCRIPTION OF THE INVENTION

Figure 1:
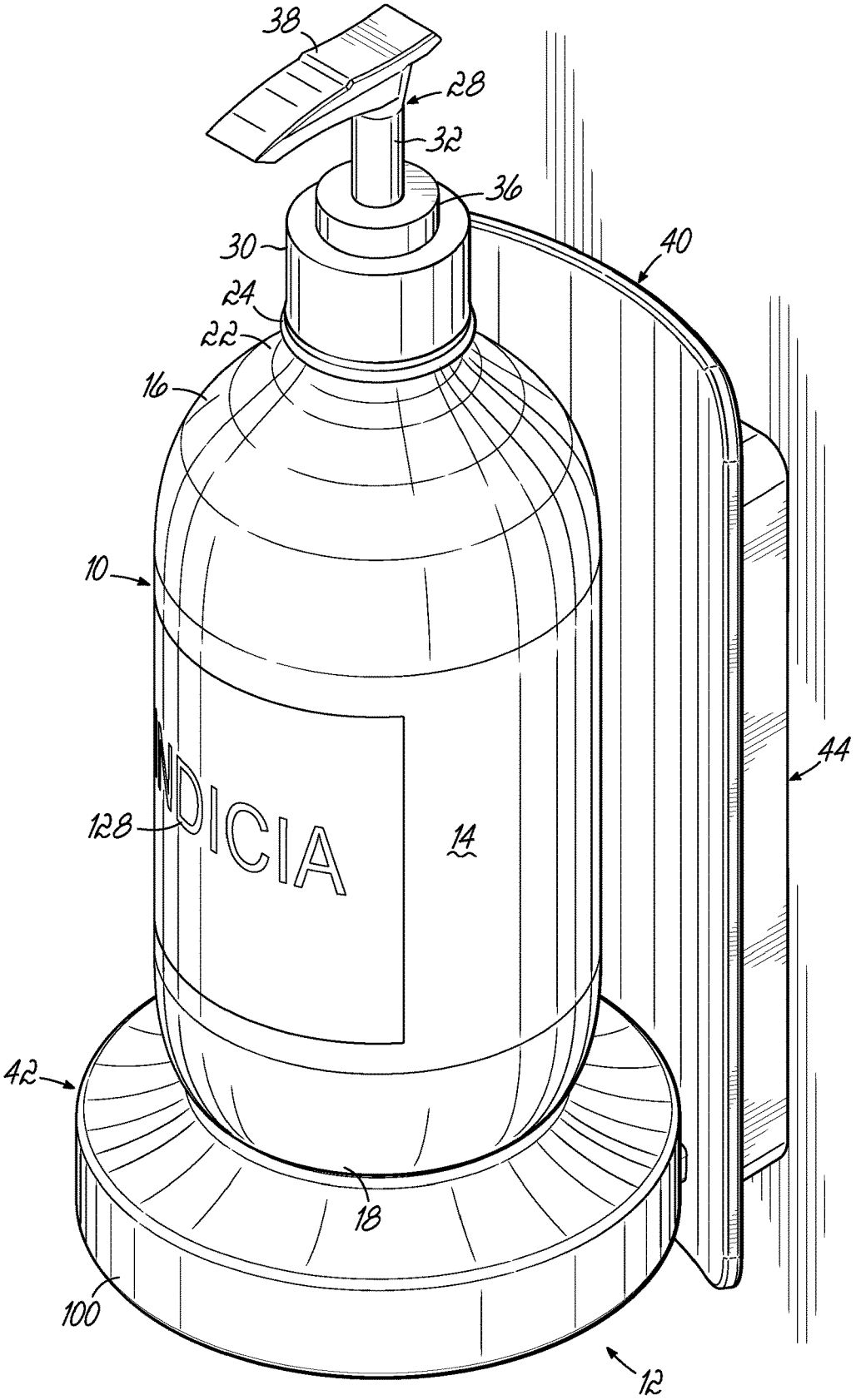
FIG. 1 is a perspective view of a liquid dispenser bottle secured to a mounting assembly according to one embodiment of this invention.

Referring to FIG. 1, one embodiment of a dispensing system including a liquid dispenser bottle 10 coupled to a mounting assembly 12 according to this invention is shown. The dispenser bottle 10 shown in FIG. 1 is exemplary and other dispensers may be used within the scope of this invention. The dispenser bottle 10 of FIG. 1 includes a cylindrical sidewall 14 which terminates at an upper shoulder 16 of the bottle 10 and at a lower bottom 18 of the bottle 10. The bottom 18 includes a boss 20 (see FIG. 4C) which in this embodiment is centrally located on the bottom. The shoulder 16 narrows to a neck 22 with an outwardly directed rim 24. A mouth (not shown) of the bottle 10 is above the rim 24 and may have an outer thread (not shown) surrounding the mouth of the bottle 10. The outer thread allows for the selective installation of a standard or other liquid pump assembly 28 on the bottle 10. The pump assembly 28 may include an internally threaded flange 30 which mates with the outer thread proximate the mouth of the bottle 10. The pump assembly 28 may have a stem 32 with an outer thread (not shown) to selectively enable and disable the pump assembly 28 by releasing from and mating with, respectively, an inner thread (not shown) on a bushing 36 extending upwardly from the flange 30. The stem 32 is in communication with a dip tube (not shown) in the interior of the bottle 10 to draw the liquid from the bottle 10 through the dip tube and stem 32 and out of a dispensing nozzle 38 in response to a downward pumping action as is common with many dispensers well-known in the art. One of ordinary skill in the art will appreciate that other bottle configurations and/or pump assemblies may be utilized within the scope of this invention.

Figure 2A:
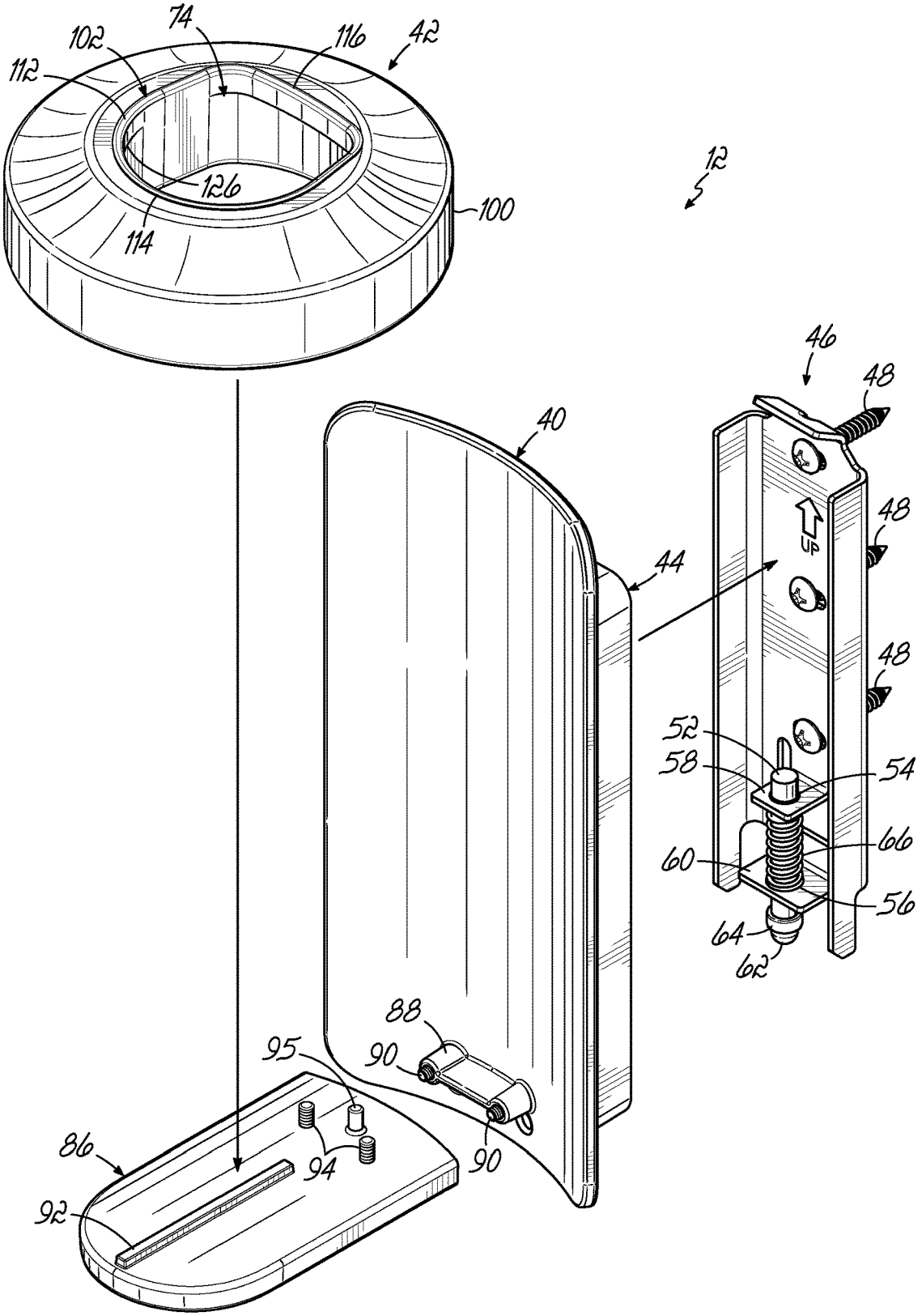
FIG. 2A is an exploded perspective view of the mounting assembly of FIG. 1.

The mounting assembly 12 of FIG. 1 includes a curved shield 40 and a base assembly 42 supporting the bottle 10. A frame 44 extends rearwardly on the shield 40 and is adapted to selectively mate with a mounting bracket 46 which can be used to secure the mounting assembly 12 and bottle 10 supported thereon to a wall 26 or other vertical surface as shown in FIGS. 2A, 3 and 4A.

Referring additionally to FIGS. 4B-4E, the mounting bracket 46 may be secured to the wall 26 by wall screws and anchors 48 and includes an upper obliquely oriented sill 50 adapted to support the frame 44 of the shield 40. A vertically oriented mounting pin 52 is inserted into an upper mounting pin hole 54 and a lower mounting pin hole 56 in upper and lower generally horizontal flanges 58, 60, respectively. The mounting pin 52 may have a head 62 and an annular rim 64. A mounting pin spring 66 surrounds the mounting pin 52 and is captured between the upper and lower flanges 58, 60 to bias the mounting pin 52 downwardly.

Figure 3:
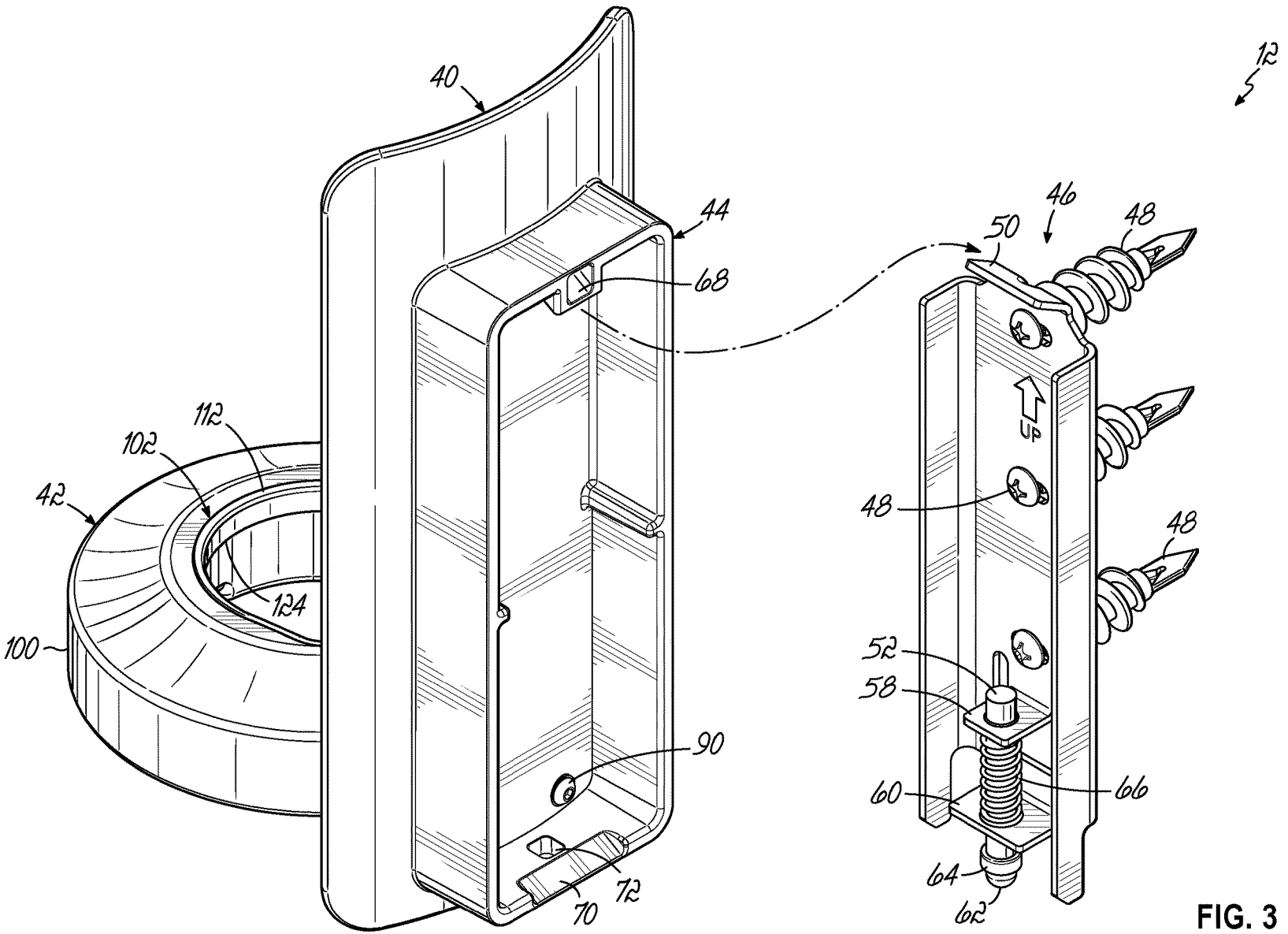
FIG. 3 is a perspective view of a mounting bracket and mounting assembly of FIG. 1.
Figure 4A:
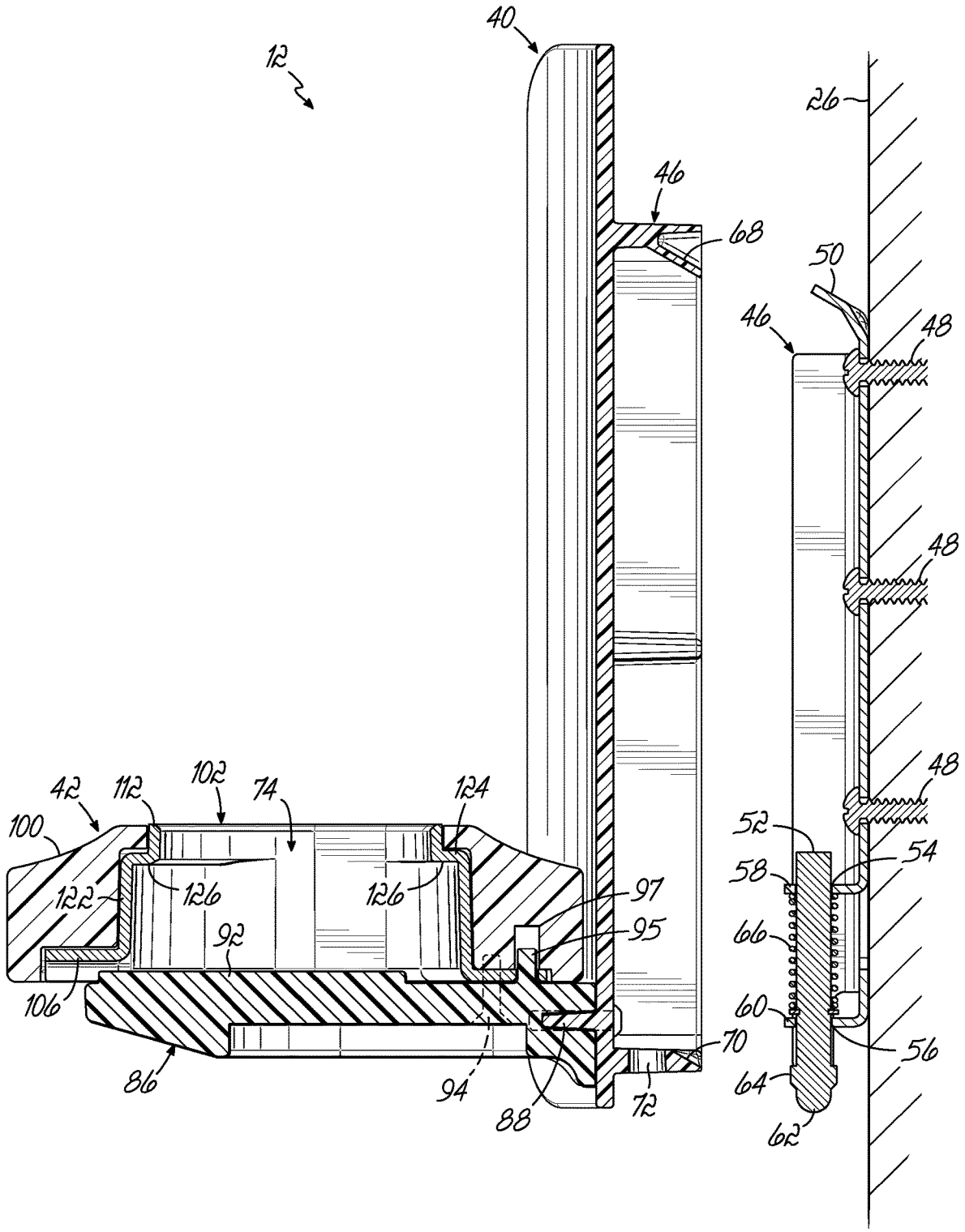
FIGS. 4A-4B are cross-sectional, side elevational sequential views of the mounting assembly being installed onto the mounting bracket secured to a wall of the embodiment of FIG. 1.

The mounting assembly 12 and attached bottle 10 may be mounted to the wall 26 by hooking a stud 68 extending downwardly from the upper interior of the frame 44 atop the sill 50 of the mounting bracket 46 as shown in FIG. 3. The mounting assembly 12 then pivoted in the direction of arrow A toward the wall 26 and mounting bracket 46 thereon until a leading sloped edge 70 on the lower portion of the frame 44 contacts the head 62 of the mounting pin 52 as in FIG. 4B. Continued pivotal movement of the shield 40 and frame 44 toward the wall 26 will force the pin 52 upwardly as the head 62 slides up the sloped edge 70 of the frame 44 until the head 62 of the pin 52 is seated in a mounting hole 72 on the frame 44. The pin spring 66 urges the pin 52 toward the lower portion of the frame 44 to be seated in the hole 72. The mounting assembly 12 is then releasably, but securely mounted to the wall 26 as shown in FIG. 4C.

The shield 40 and base assembly 42 may be removed from the wall 26 by pushing the head 62 of the pin 52 upward until it is unseated from the mounting hole 72 and then the lower end of the frame 44 may be pivoted away from the wall 26 and the sloped edge 70 removed from the pin 52 of the mounting bracket 46.

Figure 2B:
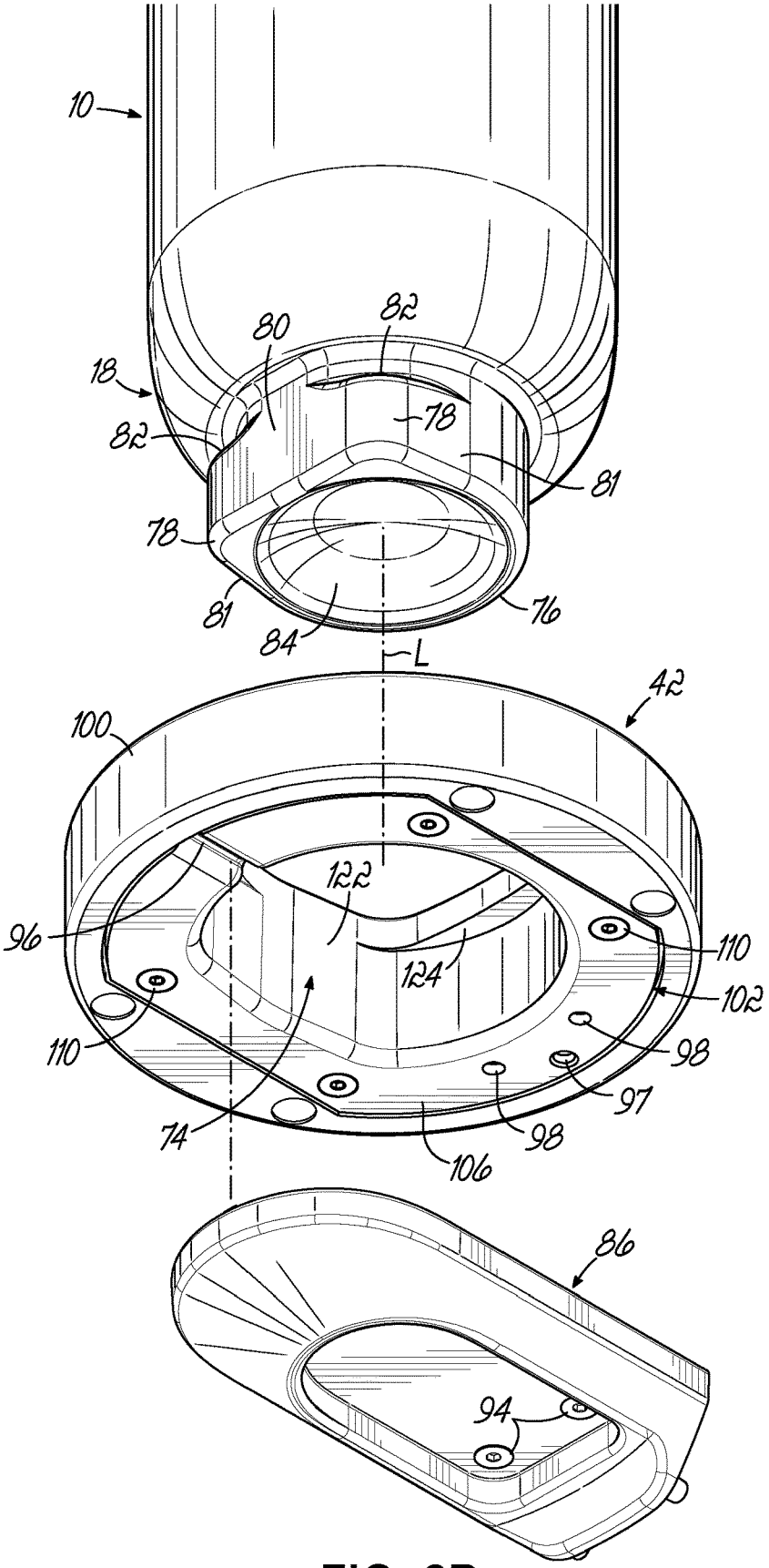
FIG. 2B is a bottom perspective view of portions of the liquid dispenser bottle and the mounting assembly of FIG. 1.

Referring to FIGS. 4C-6B, the dispenser bottle 10 may be selectively mounted to and removed from in reverse operation relative to the base assembly 42 by inserting the boss 20 extending from the bottom 18 of the bottle 10 into a socket 74 in the base assembly 42. As shown in FIG. 2B, the boss 20 according to one embodiment of this invention has an arcuate sidewall portion 76 and a pair corners 78 spaced on either side of a flat sidewall portion 80. The lower surface 84 of the boss 20 is concave in one embodiment. Referring additionally to FIG. 7, a flat transition portion 82 is outboard of each corner 78 to merge the arcuate portion 76 to the respective corner 78. The corners 78 and adjacent parts of the associated transition portion 81 and flat portion 80 contribute to forming an upper brace in the form of a ledge 82 on the boss 20. Two ledges 82 are formed on the boss 20, each associated with one of the corners 78. The boss 20 according to this invention may take other configurations and may be integrally formed with the bottle 10 or added onto the bottom 18 of the bottle 10.

Referring to FIG. 2A, the mounting assembly 12 according to this embodiment of the invention includes the base assembly 42 which is supported by a shelf 86 in the form of a tongue projecting from the shield 40. The shelf 86 is secured to a projection 88 at the lower end of the shield 40 with a pair of screws 90 to engage the shelf 86 and secure it to the shield 40. The shelf 86 has a longitudinal rib 92 on its upper surface and set screws 94 extending upwardly from the shelf 86. Referring additionally to FIG. 2B, the rib 92 mates with a channel 96 and alignment pin 95 mates with opening 97 in the base assembly 42 and the screws 94 secure the base assembly 42 to the shelf 86 by threadably inserting into holes 98 in the base assembly 42.

Figure 8:
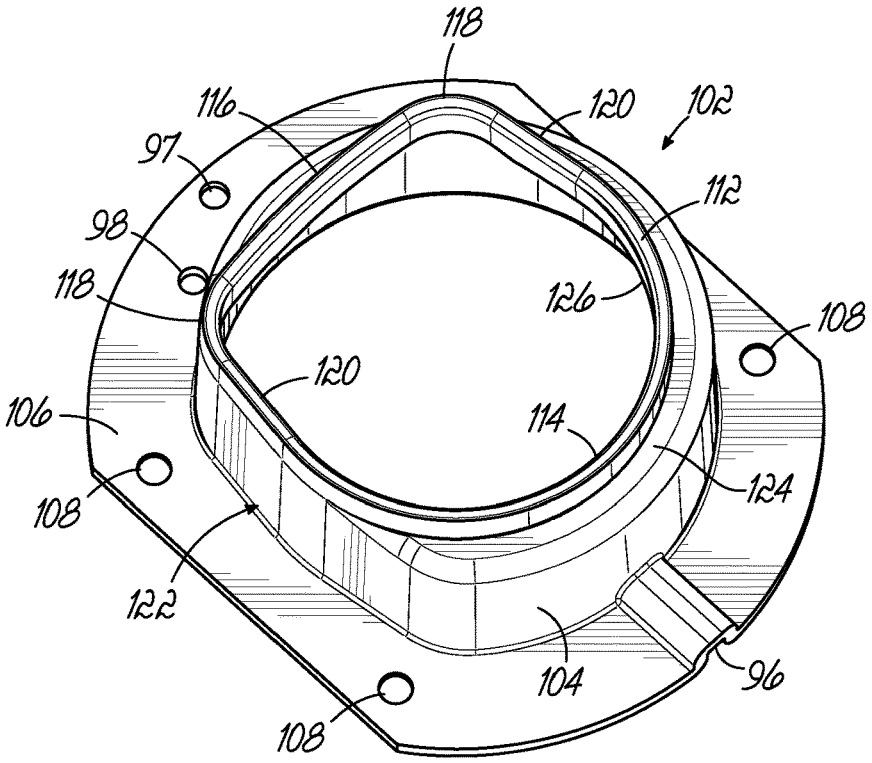
FIG. 8 is a top perspective view of a mounting collar of the mounting assembly according to one embodiment of this invention.

The base assembly 42 according to one embodiment of this invention includes an outer ring 100 and an insert 102 seated within the ring 100. The insert 102 is shown in FIG. 8 apart from the ring 100 and includes a collar 104 surrounded by a flange 106. The collar 104 forms the socket 74 within the ring 100 of the base assembly 42. The channel 96 is formed in the flange 106 and the flange 106 includes holes 108 through which screws 110 may be inserted to secure the insert 102 to the ring 100. The collar 104 includes an upper rim 112 which includes an arcuate portion 114, a straight or generally linear portion 116 between a pair of corners 118. Each corner 118 of the rim 112 has a transition portion 112 joining it to the arcuate portion 114. The rim 112 is raised from the flange 106 by a pedestal 122. The rim 112 is offset from the pedestal 122 proximate to the arcuate portion 114 of the rim 112 to form a ledge 124 at the top of the pedestal 122. The insert 102 includes an overhang portion 126 opposite from the ledge 124 as shown in FIGS. 4A-4E.

Figure 4B:
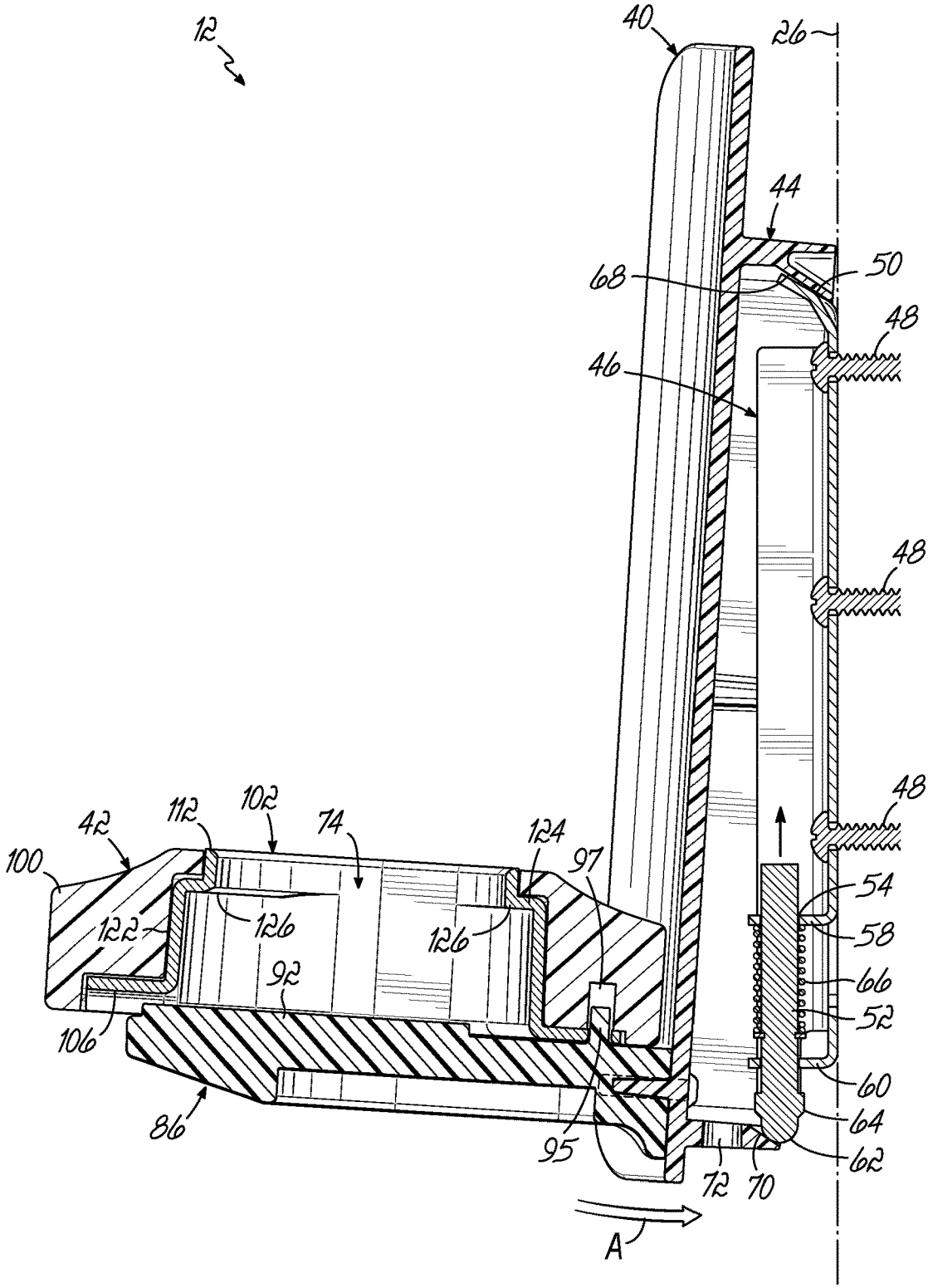
Figure 4C:
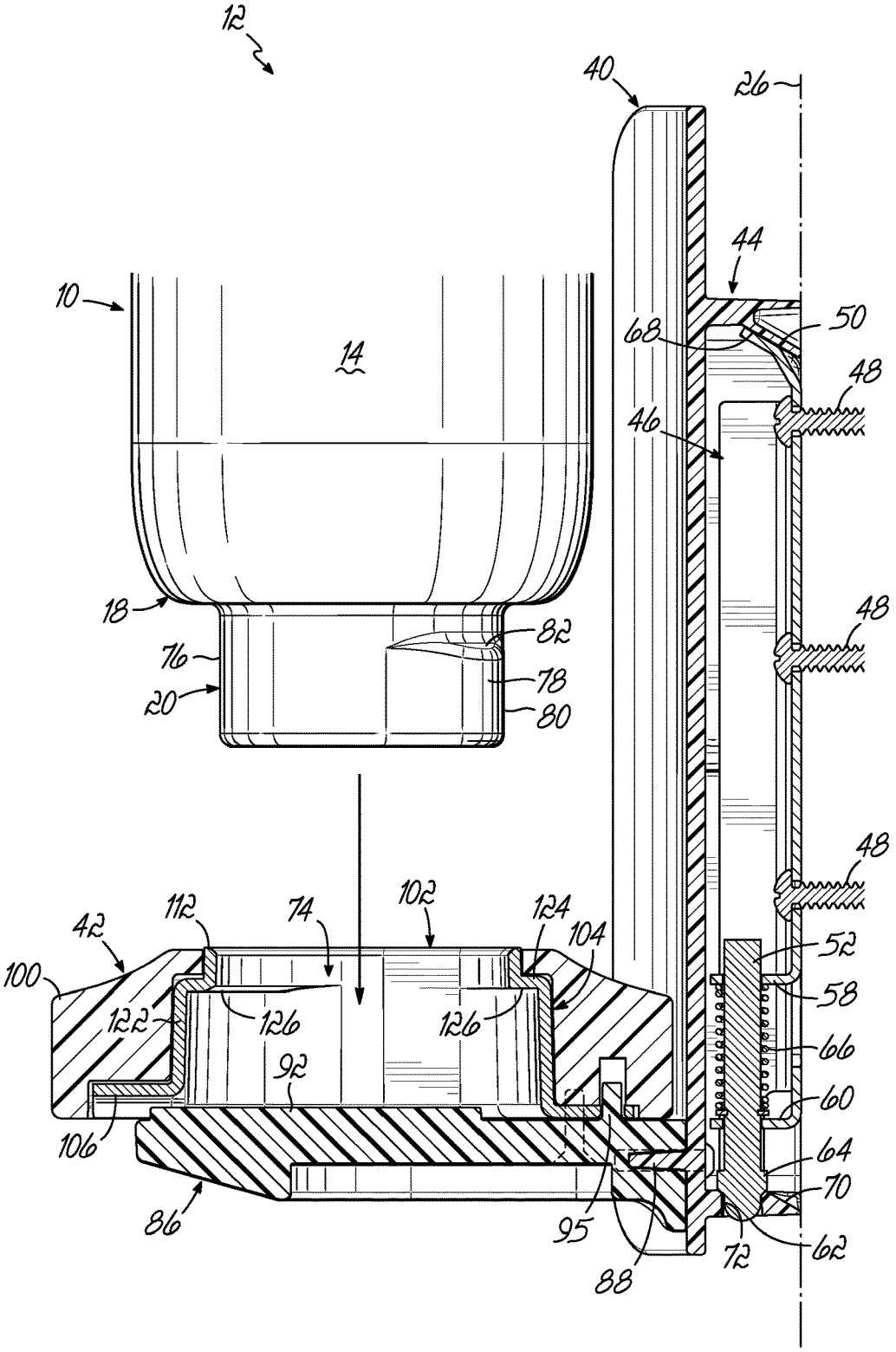
FIG. 4C-4E are cross-sectional, side elevational sequential views of the liquid dispenser bottle being installed onto the mounting assembly of FIG. 1.
Figure 4D:
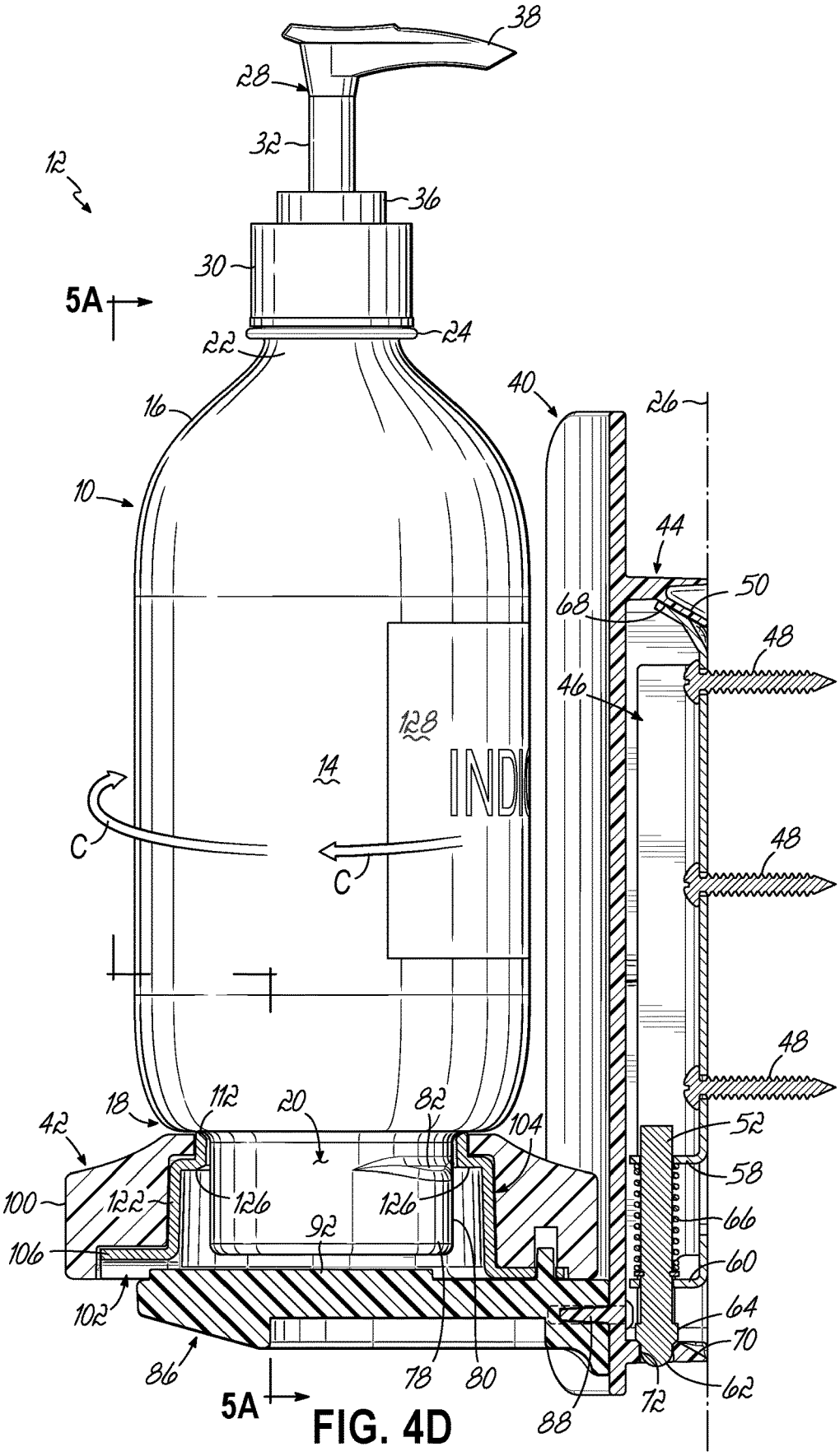
Figure 4E:
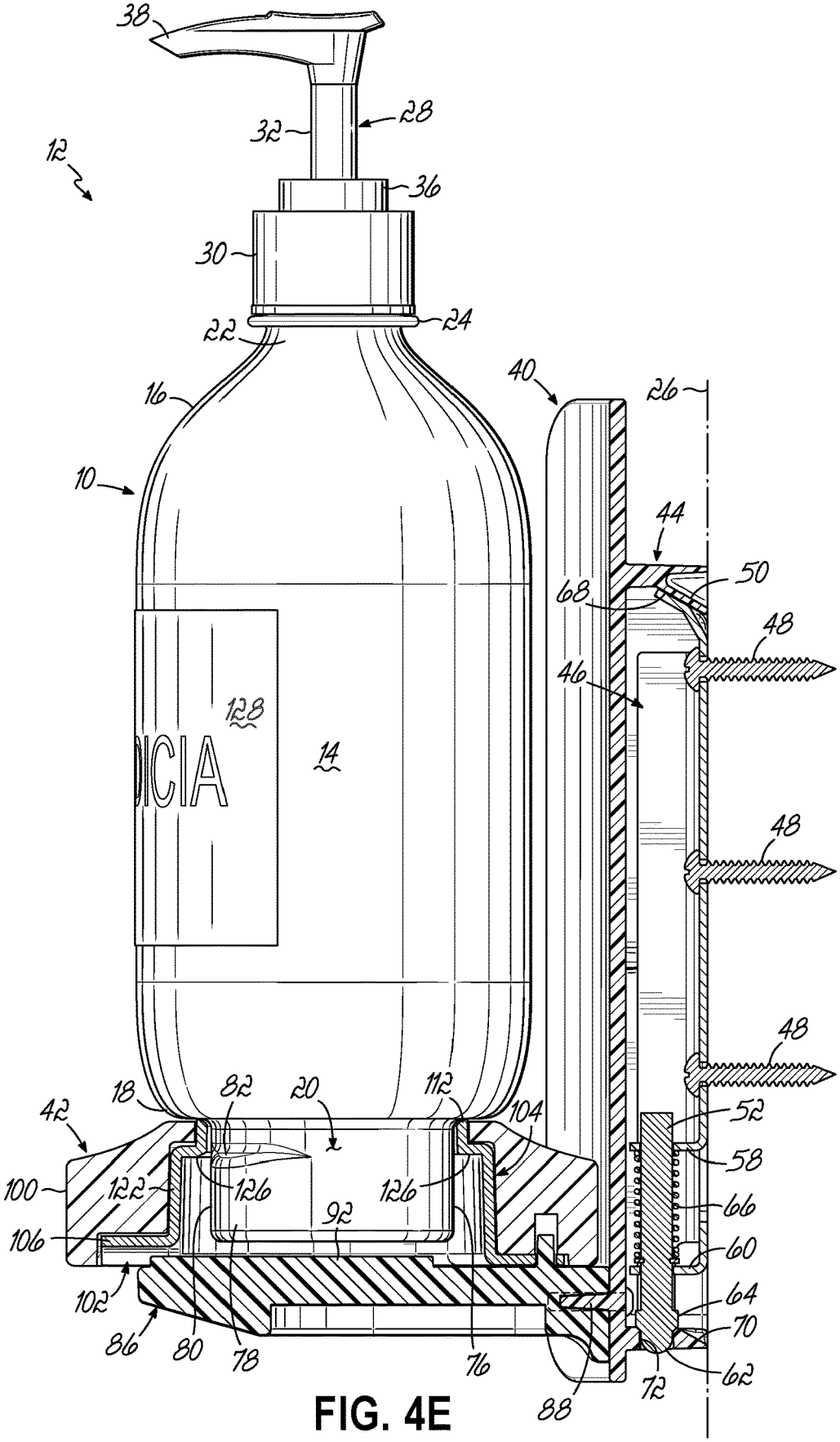
Figure 5A:
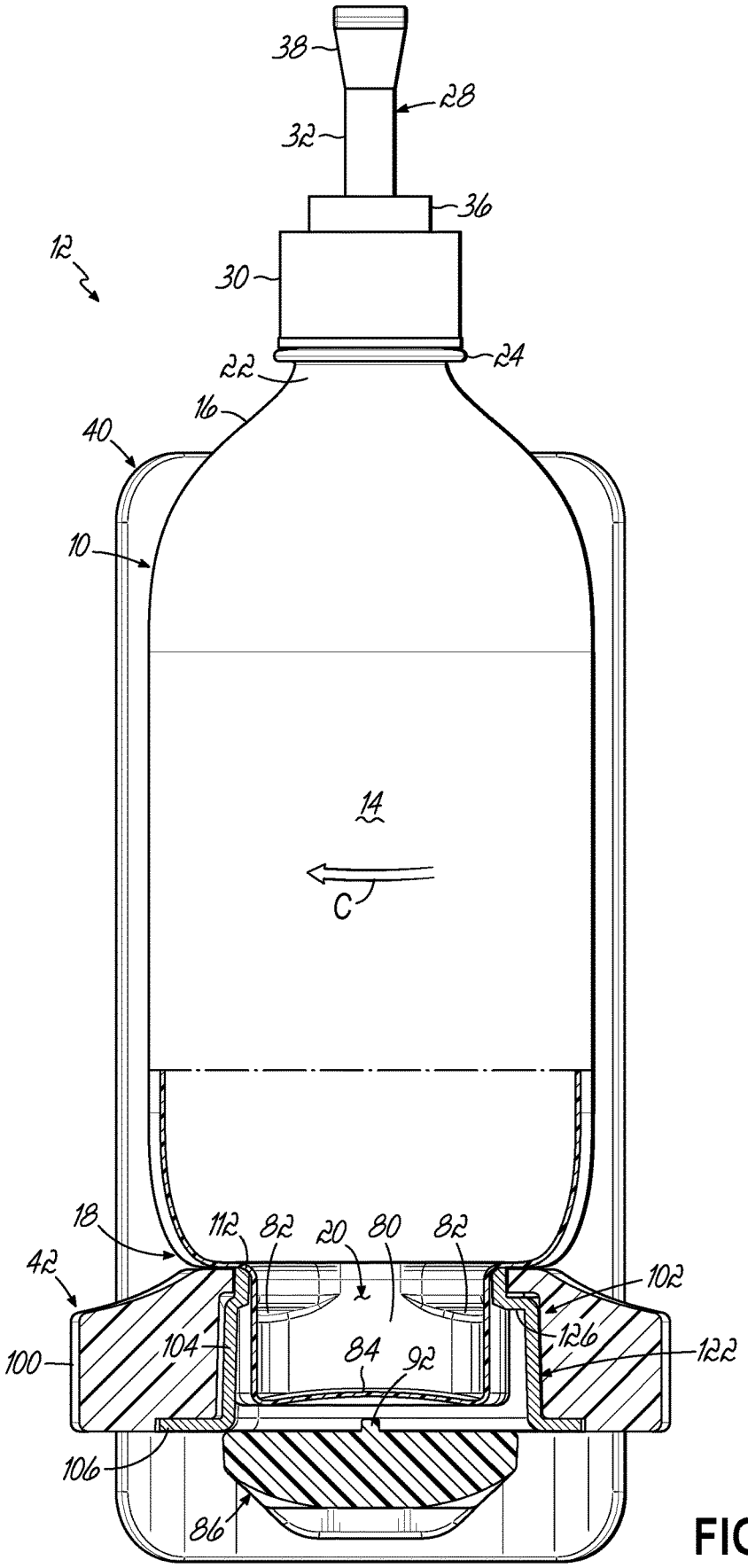
FIGS. 5A-5C are front elevational, partial cross-sectional sequential views of the liquid dispenser bottle being installed onto the mounting assembly of FIG. 1.
Figure 5B:
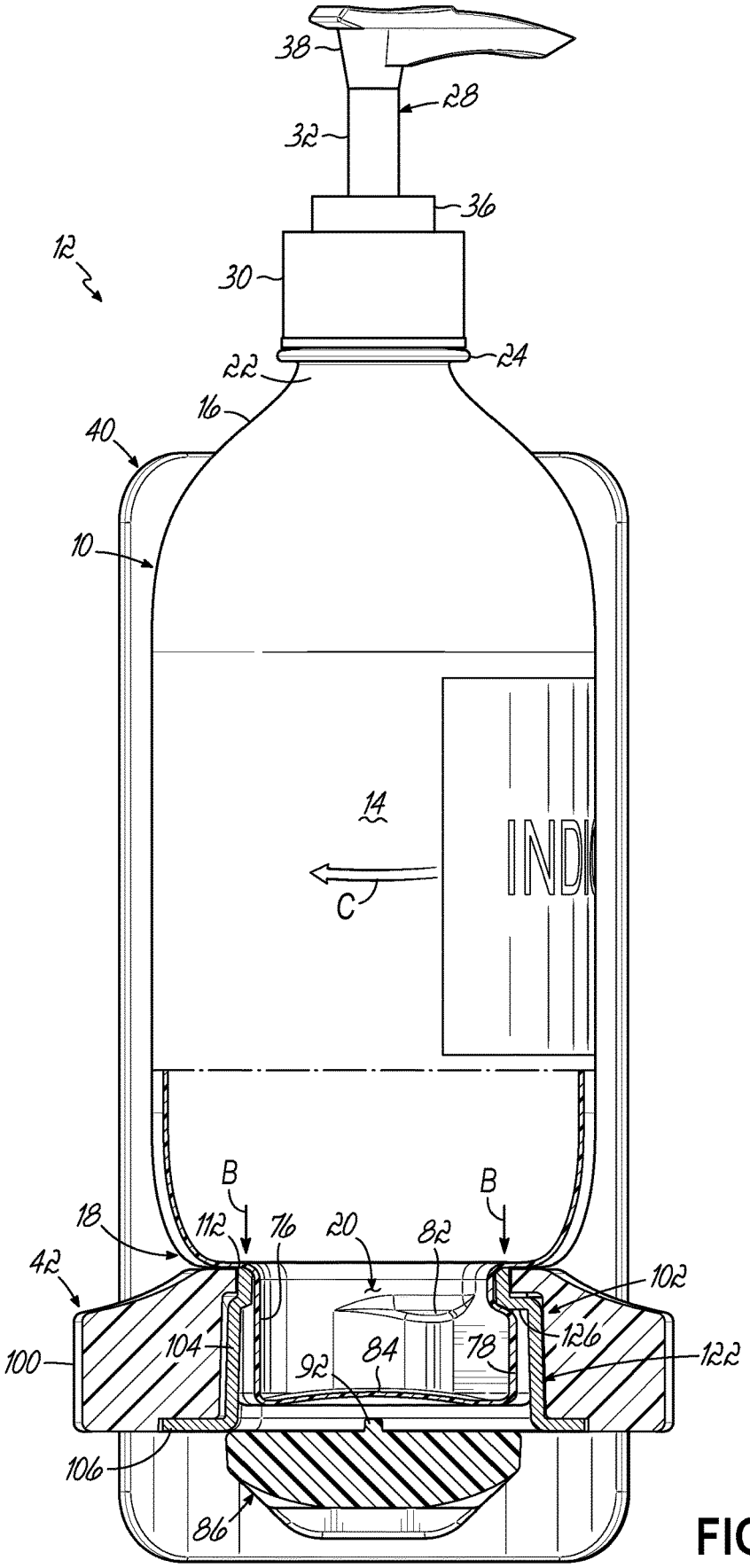
Figure 5C:
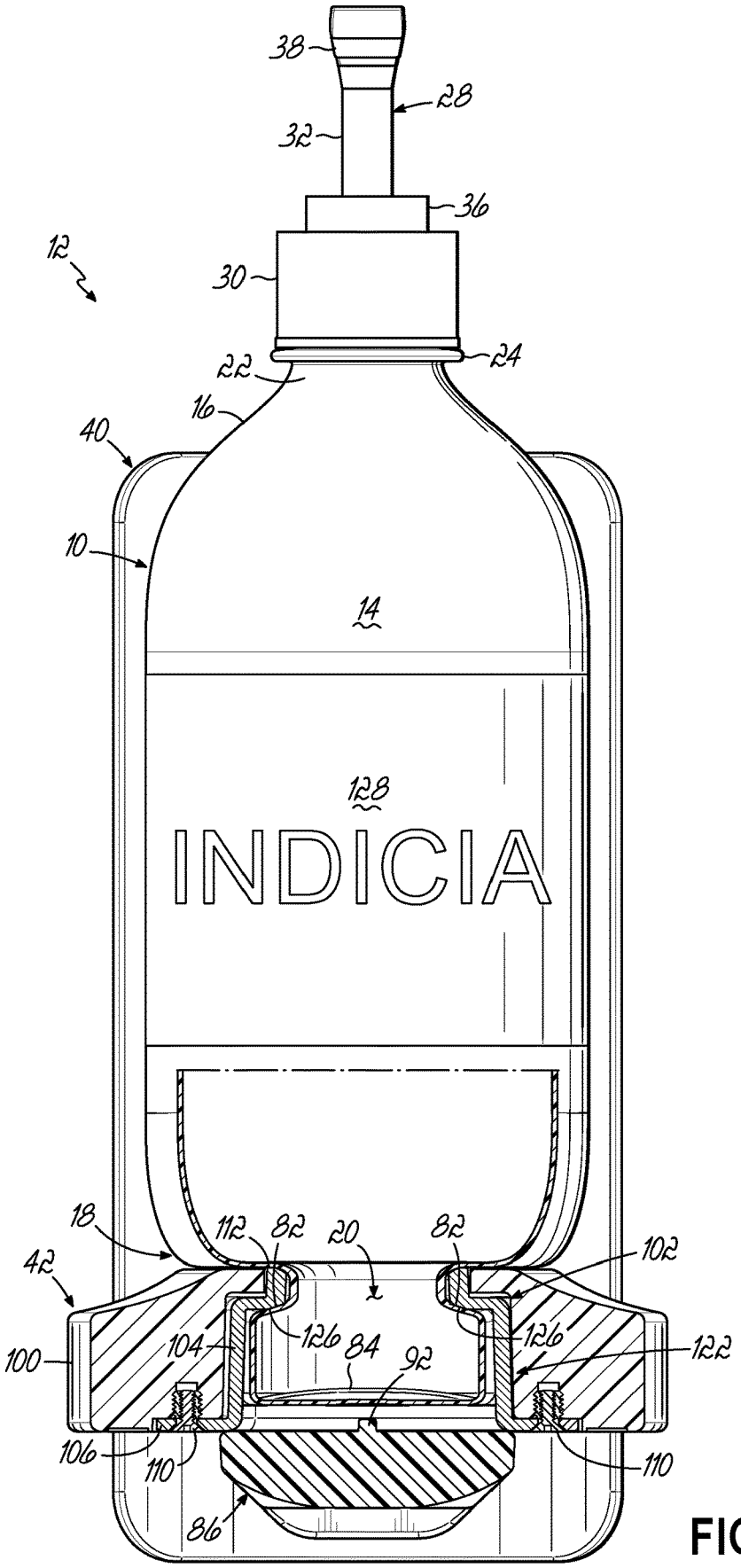

Referring to FIGS. 4C-6B, the bottle 10 is mounted to the mounting system 12 as shown by the sequential cross sectional views of FIGS. 4A-4E. The base assembly 42 and shield 40 are secured to the mounting bracket 46 as shown in FIGS. 4A-4B. The bottle 10 is secured to the base assembly 42 either before or after the base assembly 42 is secured to the mounting bracket 46 according to one aspect of this invention as shown in FIGS. 4C-4E. The bottle 10 is inserted downwardly in the direction of arrow B with the flat sidewall portion 80 of the boss 20 directed toward the shield 40 as shown in FIG. 4C. In this orientation, the flat sidewall portion 80 of the boss 20 is aligned with the straight portion 116 of the rim 112 allowing the boss 20 to pass through the rim 112 and be seated in the socket 74. The bottle sidewall 14 may bear a label or other indicia 128 which is aligned with the flat sidewall 80 of the boss 20 and initially confronting the shield 40.

Once the boss 20 is seated in the socket 74, the bottle 10 may be rotated clockwise or counter-clockwise about a longitudinal axis L of the bottle (see FIG. 2B). Arrows C in FIG. 4D show the rotation of the bottle relative to the insert 102 and collar 104 approximately 180° until the flat sidewall portion 80 of the boss 20 and label 128 are oriented forwardly and away from the shield 40.

Figure 6A:
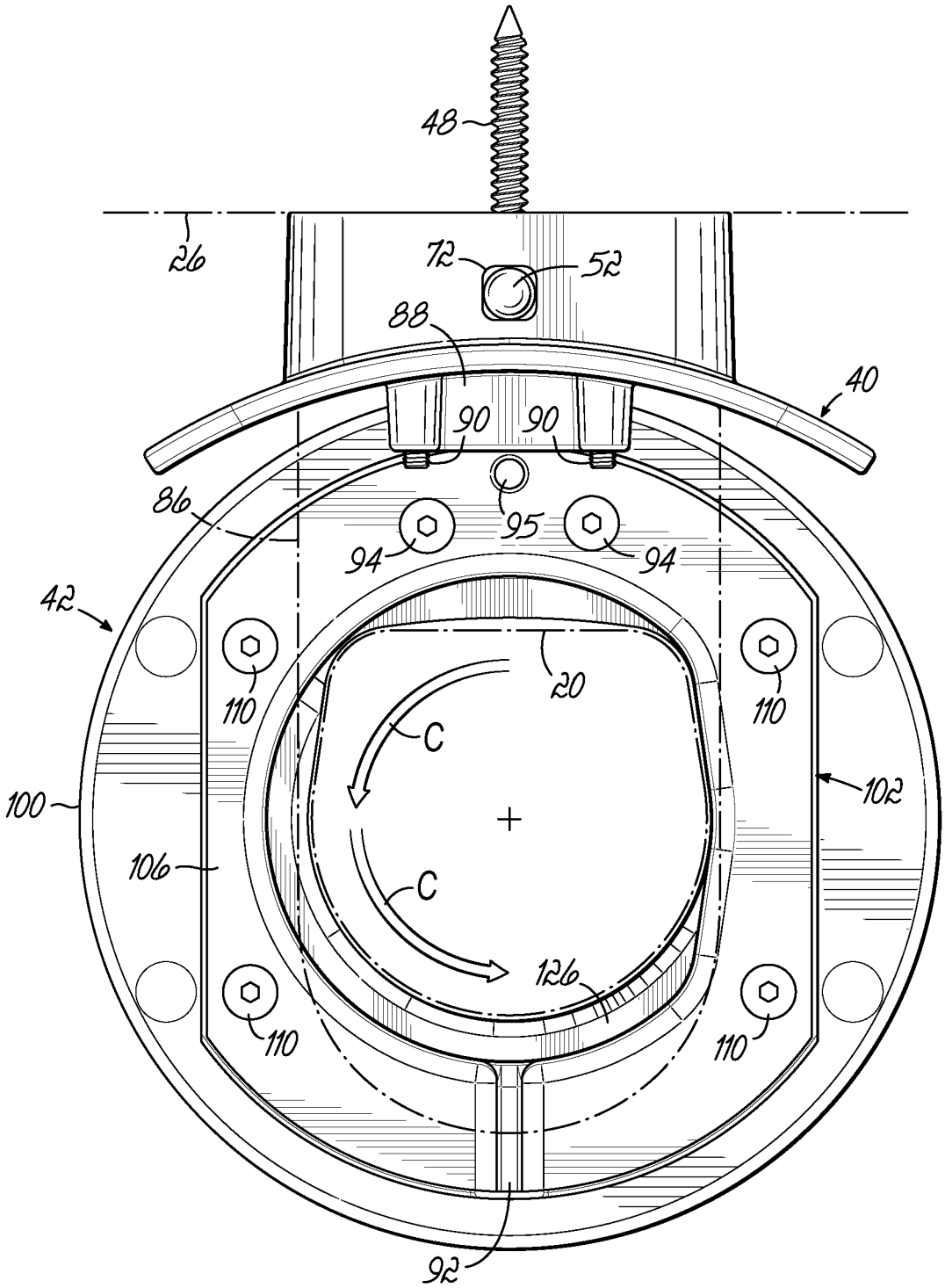
FIGS. 6A-6B are bottom elevational sequential views of the bottom of the liquid dispenser bottle being secured to the mounting assembly of FIG. 1.
Figure 6B:
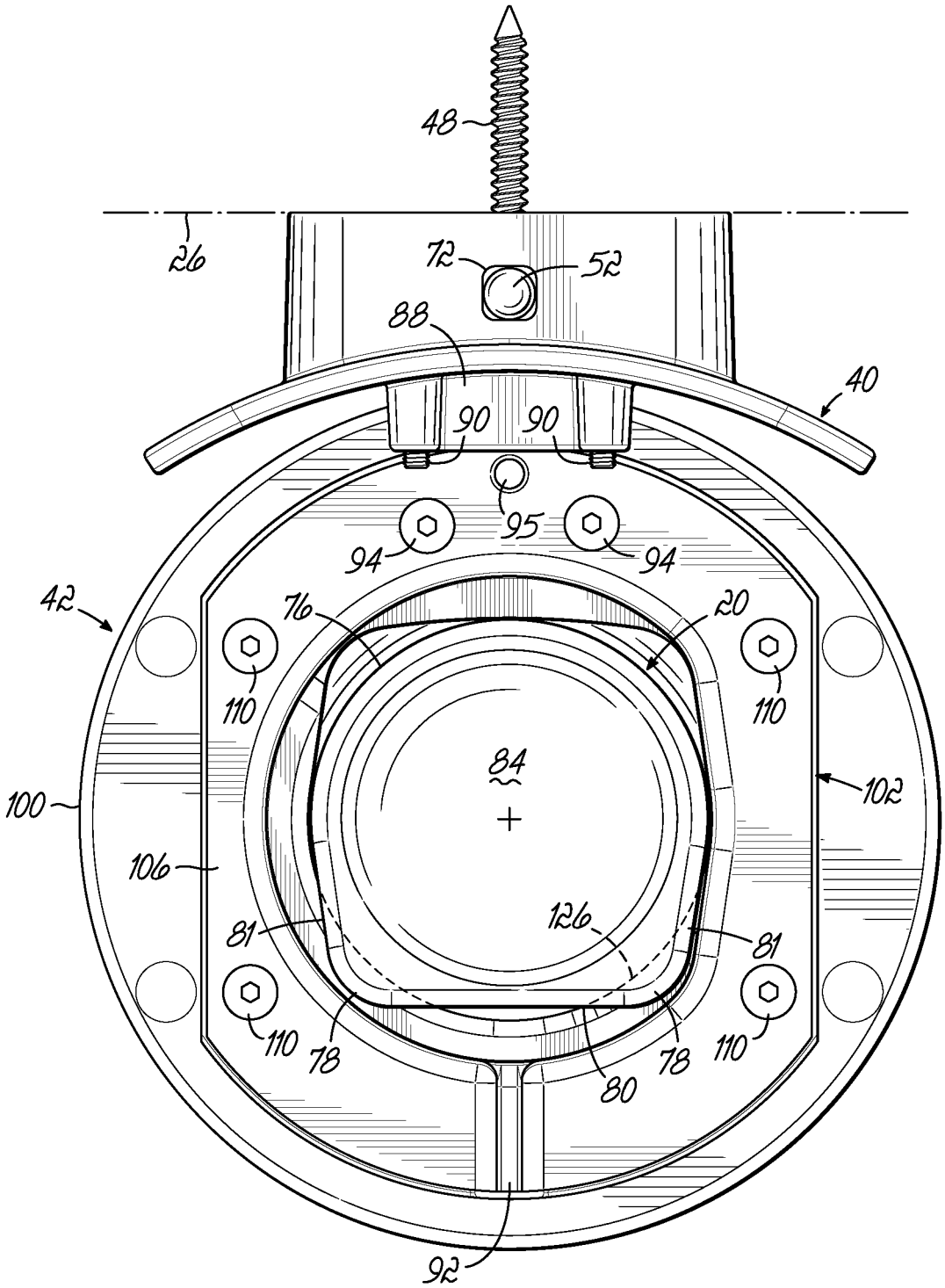
Figure 7:
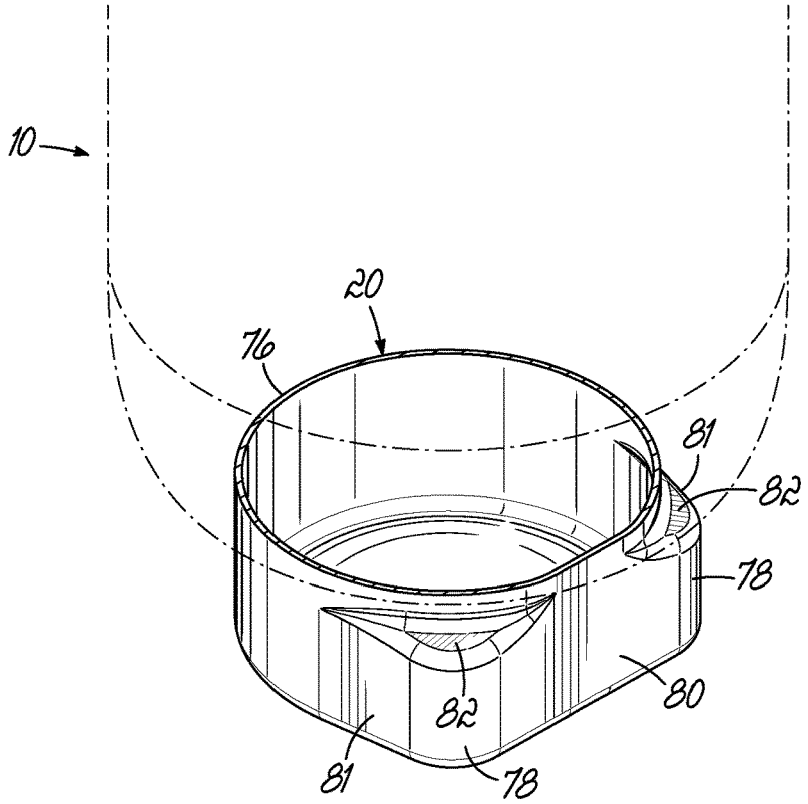
FIG. 7 is a top perspective view of the bottom of the liquid dispenser bottle of one embodiment of this invention.
Figure 9:
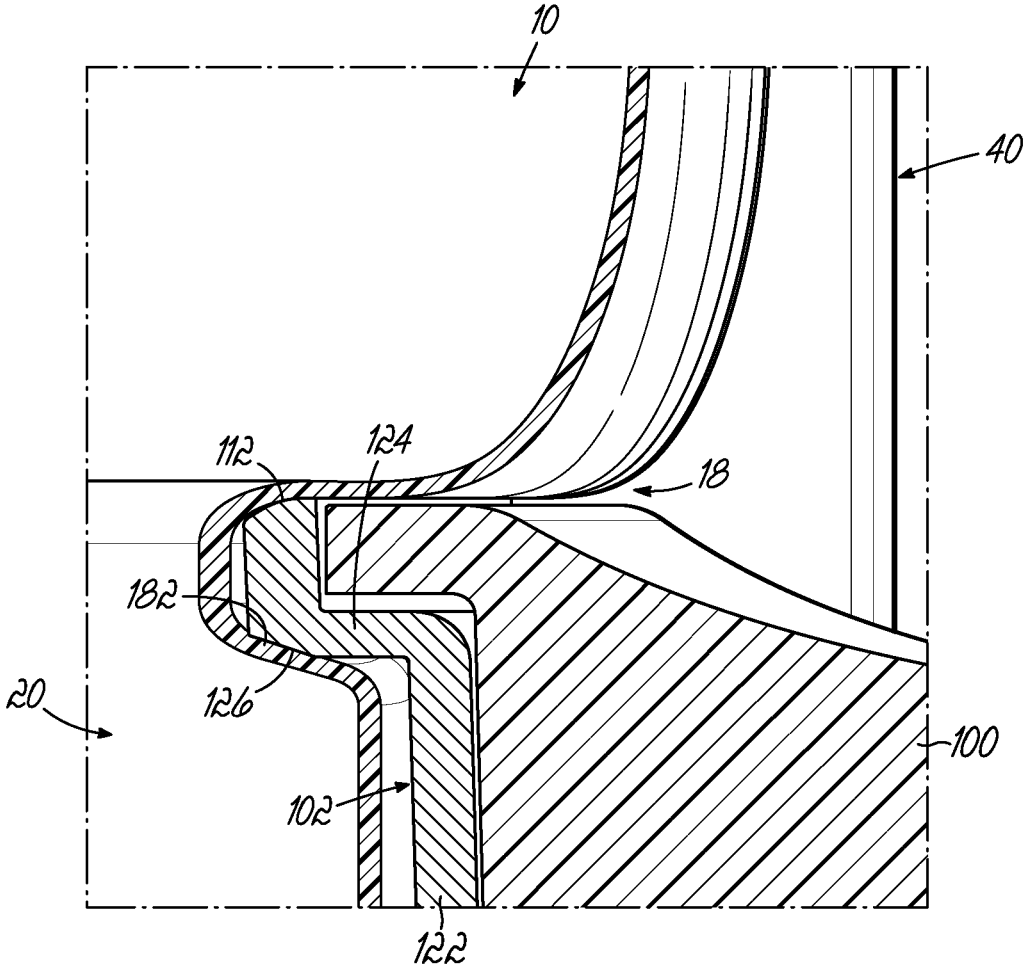
FIG. 9 is an enlarged cross-sectional view of a portion of the bottom of the liquid dispenser bottle secured to the mounting collar according to one embodiment of this invention.

The coupling of the bottle 10 with the mounting system 12 is also shown in FIGS. 5A-6B from different views. After the bottle 10 is inserted into the socket 74 and rotated 180°, the brace ledge 82 on the boss 20 is positioned beneath the ledge 124 and overhang portion 126. In this position, the brace ledge 82 is covered by the overhang portion 126 as shown in FIGS. 6B and 9 which prevents the bottle 10 from being removed from the mounting system 12. The overhang portion 126 is a detent which acts against the brace to inhibit removal upwardly of the bottle 10 from the mounting system 12. The shape of the boss 20 and of the collar 104 allows for insertion of the boss 20 into the insert 102 in a first orientation and prevents removal of the bottle 10 from the mounting system 12 in another or second orientation. In one embodiment, the first orientation allowing for insertion of the bottle 10 is 180° of rotation of the bottle 10 relative to the mounting system 12. The orientation of the label 128 when the bottle 10 is secured in the mounting system 12 of the second orientation is forward and easily readable and presentable to a user of the dispenser system.

Figure 10:
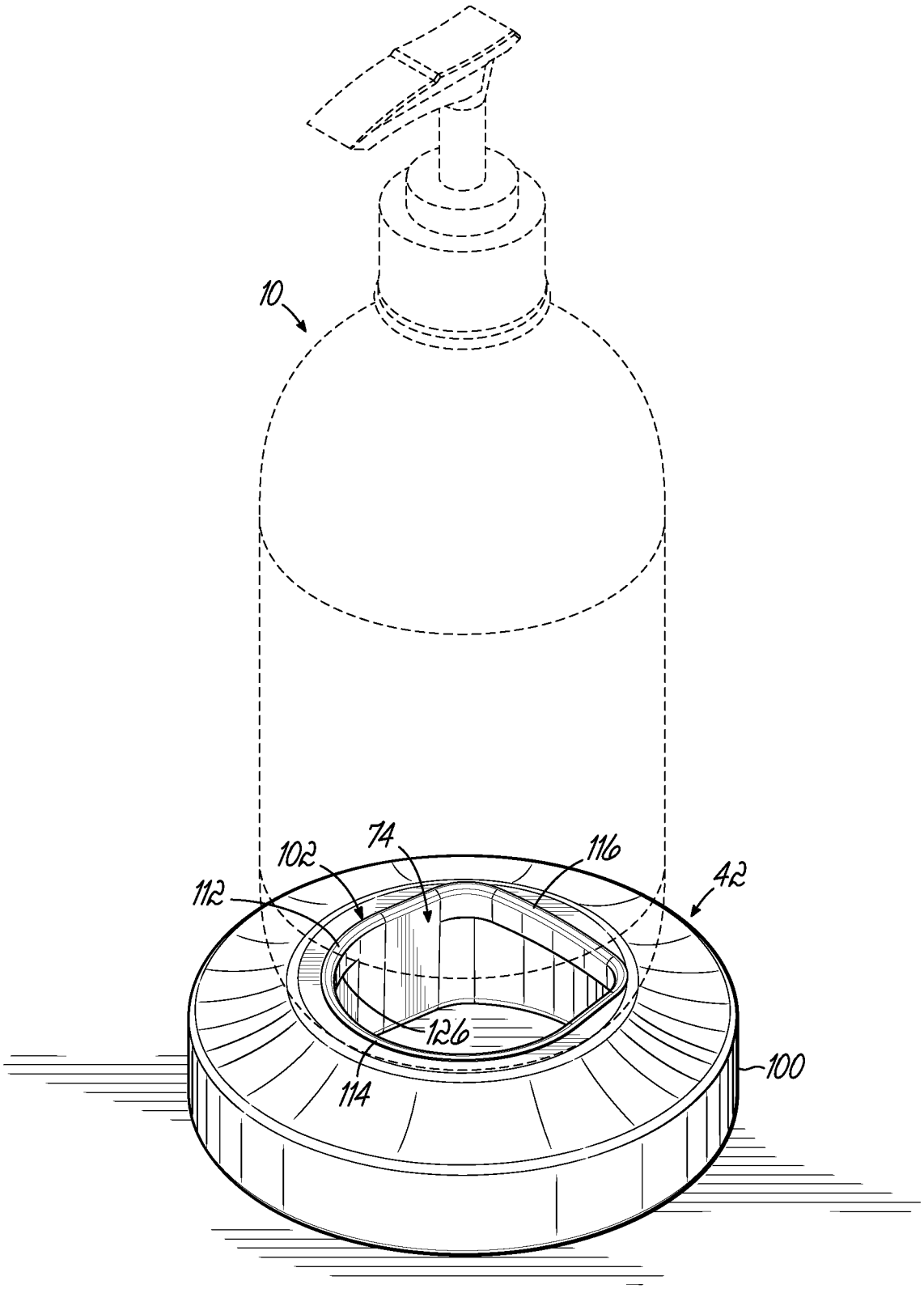
FIG. 10 is a perspective view of an alternative embodiment according to this invention.
Figure 11:
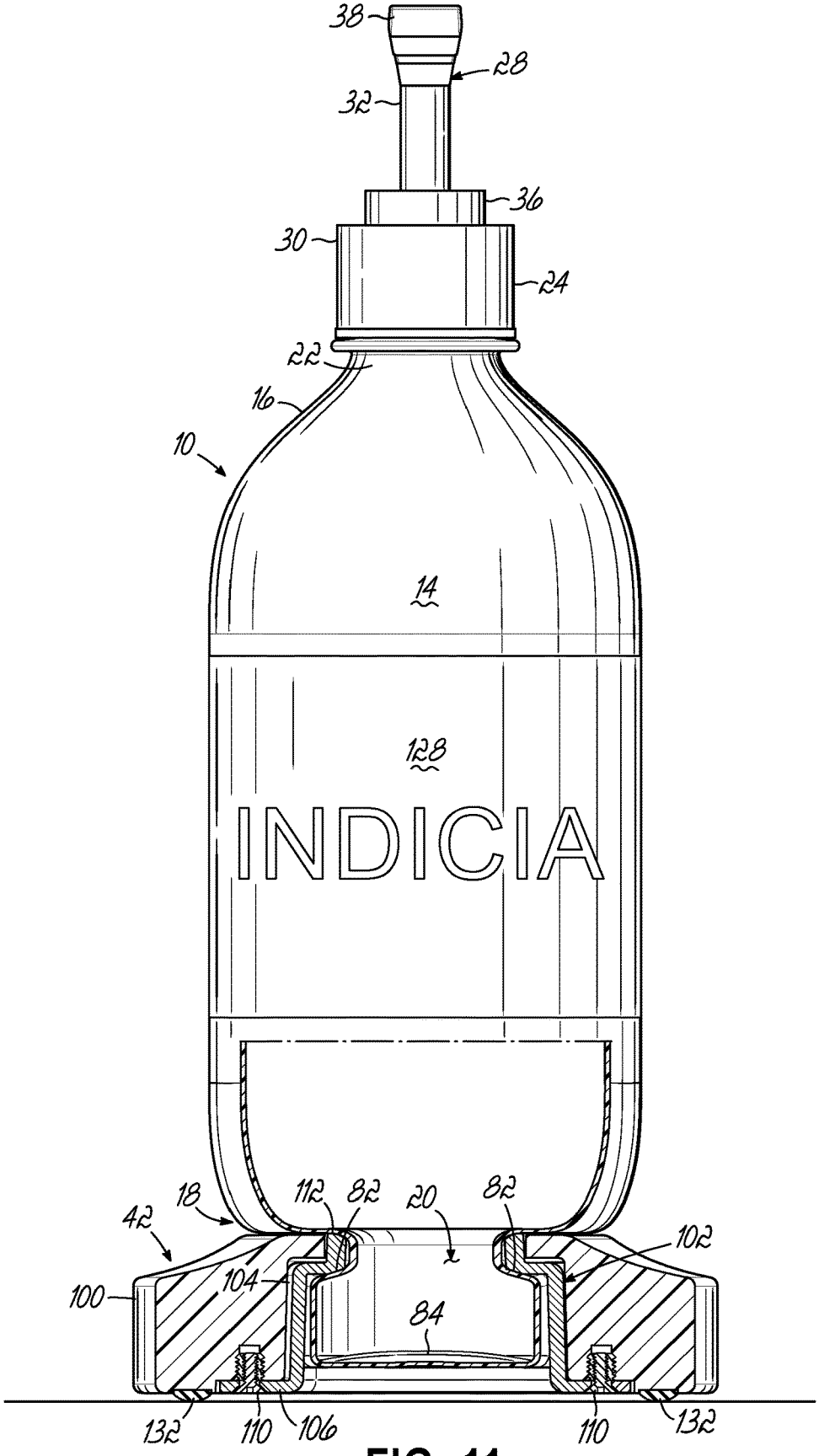
FIG. 11 is front elevational view in partial cross-section of the embodiment of FIG. 10.

An alternative embodiment of this invention is shown in FIGS. 10-11 which embodiment is adapted for use on a countertop or other horizontal surface 130. In this embodiment, the mounting system 12 includes the base assembly 42 and insert 102 with the collar 104 therein. The ring 42 of this embodiment may include feet 132 mounted on its bottom surface to support the base assembly 42 on the countertop 130.

Figure 12:
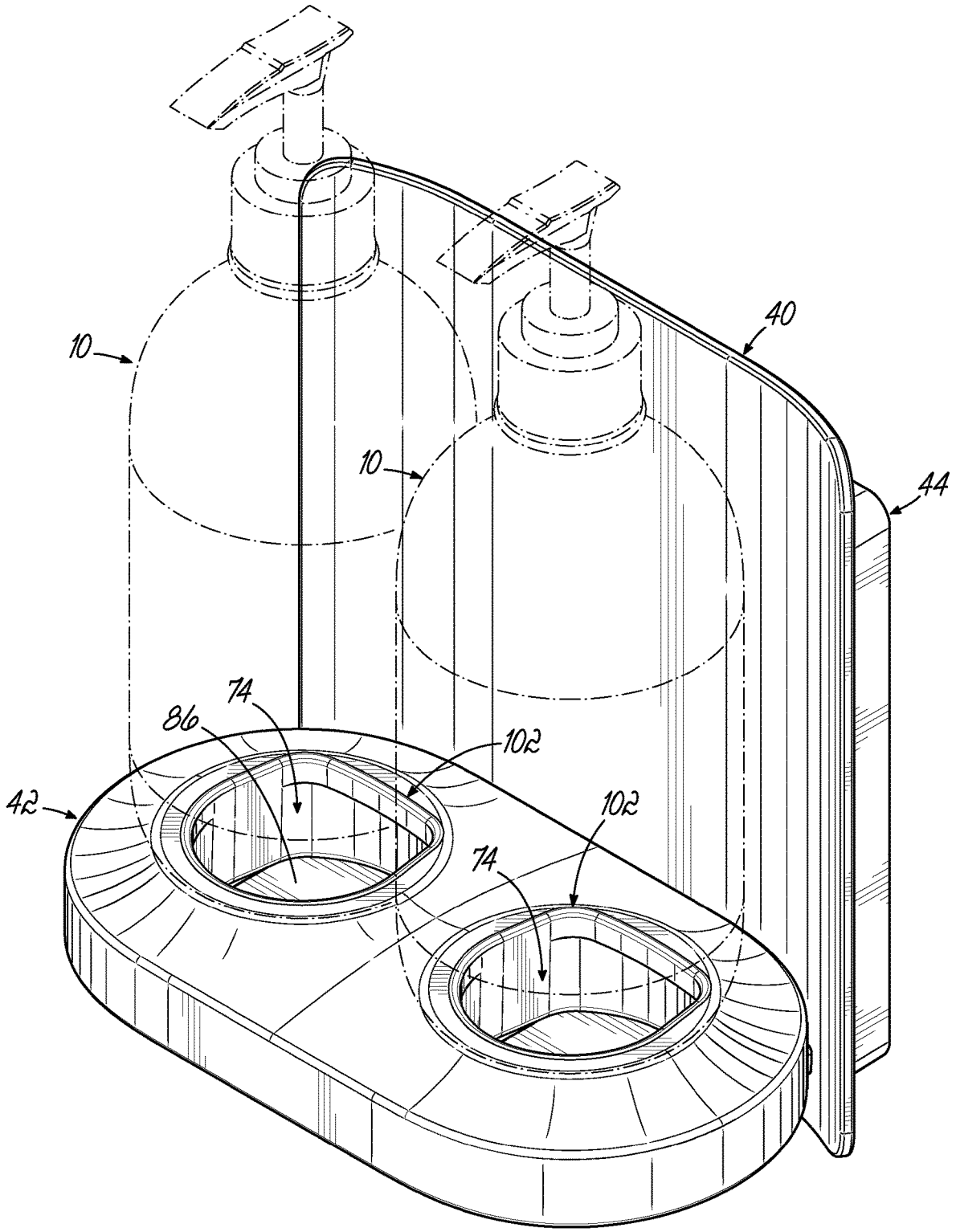
FIG. 12 is a perspective view of further alternative embodiment according to this invention.
Figure 13:
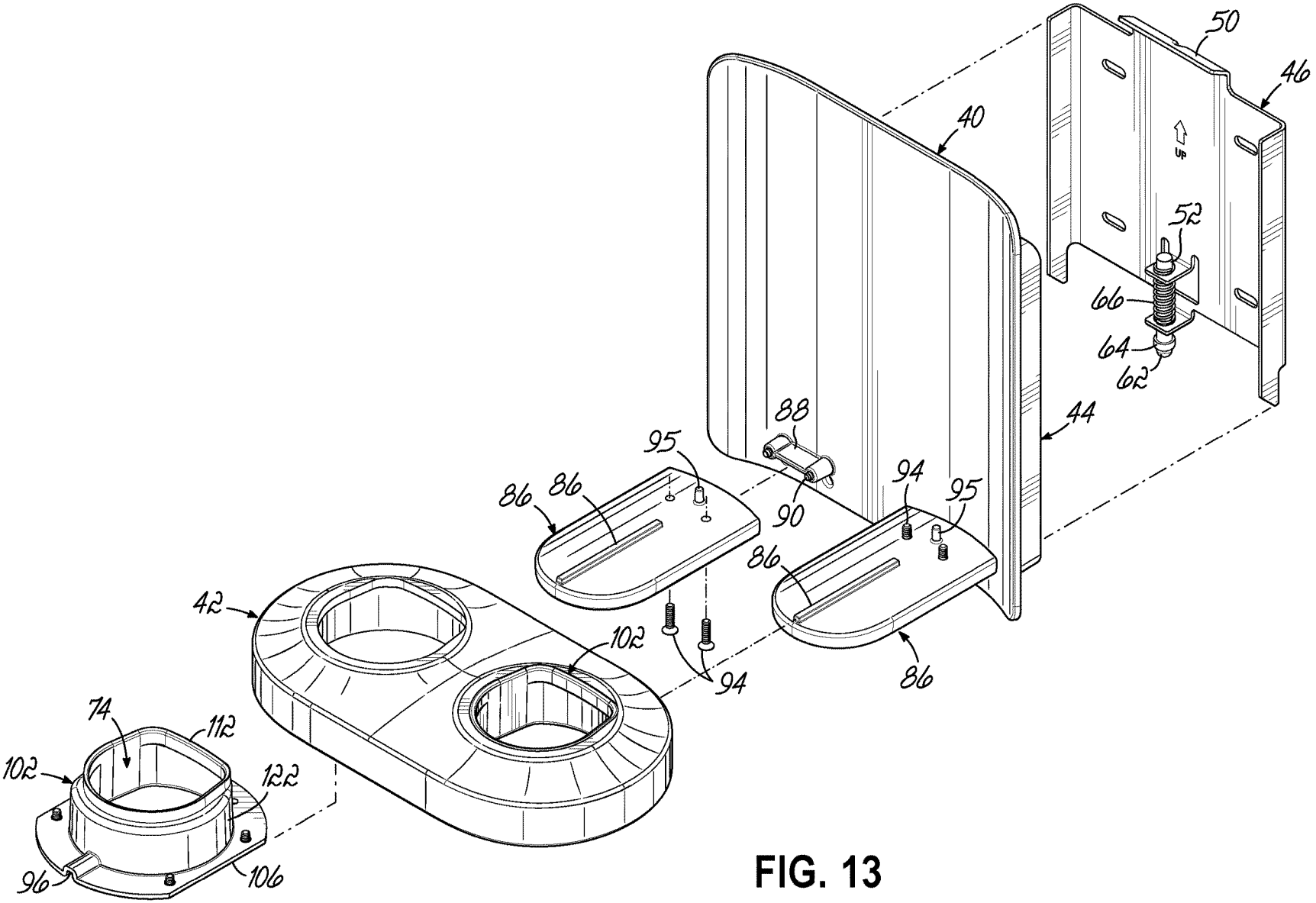
FIG. 13 is an exploded view of the embodiment of FIG. 12.

A further alternative embodiment of this invention is shown in FIGS. 12-13 which is a wall mounted version similar that shown in FIGS. 1-6B. The embodiment of FIGS. 12-13 has two dispenser bottles 10 mounted on the mounting system 12 which has two inserts 102 and two collars 104 in the base assembly 42. As shown in FIG. 13, the mounting system 12 of this embodiment includes two shelves 86 and projections 88 on the shield 40 to attach the base assembly 42 thereto. Further alternative embodiments are contemplated within the scope of this invention, including, but not limited to, a countertop embodiment for more than one bottle 10 and countertop or wall mounted embodiments that accommodate one, two or more than two bottles 10.

From the above disclosure of the general principles of this invention and the preceding detailed description of at least one embodiment, those skilled in the art will readily comprehend the various modifications to which this invention is susceptible. Therefore, we desire to be limited only by the scope of the following claims and equivalents thereof.

We claim:

1. A liquid dispenser assembly comprising:

a dispenser bottle having a bottom, a top and a sidewall extending between the top and bottom;

a pump assembly coupled to the dispenser bottle for pumping a liquid contained within the dispenser bottle out of the dispenser bottle;

a mounting assembly to support the dispenser bottle on a surface and to which the dispenser bottle is selectively mounted thereto;

a socket in the mounting assembly; and a boss on the bottom of the dispenser bottle;

wherein the socket is sized and configured to receive therein the boss in a first orientation and inhibit removal of the boss therefrom in a second orientation;

wherein the boss can only be received in the socket in the first orientation;

wherein the dispenser bottle is rotated about an axis extending between the top and bottom to orient the boss to and between the first and second orientations;

wherein the boss further comprises: an arcuate boss portion oriented generally parallel to the axis; a flat boss portion oriented generally parallel to the axis; and at least one brace proximate an intersection of the arcuate and flat boss portions.

2. The assembly of claim 1 wherein the socket further comprises:

at least one detent which is engaged with the at least one brace when in the second orientation to inhibit removal of the bottle from the mounting assembly.

3. The assembly of claim 2 wherein the socket further comprises:

an arcuate sidewall portion; and at least one flat sidewall portion.

4. The assembly of claim 3 wherein the socket further comprises:

a rim defining a mouth of the socket sized and configured to receive the boss therein in the first orientation.

5. The assembly of claim 2 wherein the brace and the detent engage one another in the second orientation in a plane which is not parallel to the axis.

6. The assembly of claim 1 wherein the boss further comprises:

a pair of the braces spaced from one another on the boss.

7. The assembly of claim 6 wherein each brace of the pair of braces is a mirror image of the other brace.

8. The assembly of claim 1 wherein the mounting assembly further comprises:

a shield extending upwardly in a direction generally parallel to the axis.

9. The assembly of claim 8 further comprising:

a mounting bracket selectively coupled to the shield for securing the assembly to the surface which is generally vertical and parallel to the axis.

10. The assembly of claim 8 further comprising:

indicia on the sidewall which confronts the shield with the bottle in the first orientation and is opposite from the shield with the bottle in the second orientation.

11. The assembly of claim 1 wherein the surface is generally horizontal and generally perpendicular to the axis.

12. The assembly of claim 1 wherein the boss is integrally molded to the dispenser bottle.

13. The assembly of claim 1 further comprising a plurality of the dispenser bottles and an equal number of sockets in the mounting assembly each of which is adapted to receive therein one of the plurality of dispenser bottles.

14. A liquid dispenser assembly comprising:

a dispenser bottle having a bottom, a top and a sidewall extending between the top and bottom and an axis extending between the top and the bottom;

a pump assembly coupled to the top of the dispenser bottle for pumping a liquid contained within the dispenser bottle out of the dispenser bottle;

a mounting assembly to support the dispenser bottle on a surface and to which the dispenser bottle is selectively mounted thereto;

a socket in the mounting assembly including an arcuate sidewall portion and at least one flat sidewall portion;

a boss integrally molded on the bottom of the dispenser bottle including an arcuate boss portion oriented generally parallel to the axis, a flat boss portion oriented generally parallel to the axis and at least one brace proximate an intersection of the arcuate and flat boss portions;

wherein the socket is sized and configured to receive therein the boss in a first orientation and inhibit removal of the boss therefrom in a second orientation;

wherein the boss can only be received in the socket in the first orientation;

wherein the dispenser bottle is rotated about the axis to orient the boss to and between the first and second orientations;

at least one detent in the socket which is engaged with the at least one brace when in the second orientation to inhibit removal of the dispenser bottle from the mounting assembly.

15. The assembly of claim 14 wherein the boss further comprises:

a pair of the braces spaced from one another on the boss wherein each brace of the pair of braces is a mirror image of the other brace.

16. The assembly of claim 14 wherein the brace and the detent engage one another in the second orientation in a plane which is not parallel to the axis.

17. The assembly of claim 14 wherein the socket further comprises:

a rim defining a mouth of the socket sized and configured to receive the boss therein in the first orientation.

18. The assembly of claim 14 wherein the mounting assembly further comprises:

a shield extending upwardly in a direction generally parallel to the axis.

19. The assembly of claim 15 further comprising a plurality of the dispenser bottles and an equal number of sockets in the mounting assembly each of which is adapted to receive therein one of the plurality of dispenser bottles.

20. The assembly of claim 18 further comprising:

a mounting bracket selectively coupled to the shield for securing the assembly to surface which is generally vertical and parallel to the axis.

21. A liquid dispenser assembly comprising:

a dispenser bottle having a bottom, a top and a sidewall extending between the top and bottom;

a pump assembly coupled to the dispenser bottle for pumping a liquid contained within the dispenser bottle out of the dispenser bottle;

a mounting assembly to support the dispenser bottle on a surface and to which the dispenser bottle is selectively mounted thereto;

a socket in the mounting assembly; and a boss on the bottom of the dispenser bottle;

wherein the socket is sized and configured to receive therein the boss in a first orientation and inhibit removal of the boss therefrom in a second orientation;

wherein the boss can only be received in the socket in the first orientation;

wherein the dispenser bottle is rotated about an axis extending between the top and bottom to orient the boss to and between the first and second orientation; and a shield coupled to the mounting assembly and extending upwardly in a direction generally parallel to the axis.

* * * * *